United States Patent [19]

Watt

[11] Patent Number: 4,938,154

[45] Date of Patent: Jul. 3, 1990

[54] SECURITY CLOSURE

[76] Inventor: Ronald W. Watt, 16 Randolph Rd., Glasgow G11 7LG, Scotland

[21] Appl. No.: 358,352

[22] PCT Filed: Jul. 18, 1988

[86] PCT No.: PCT/GB88/00575

§ 371 Date: May 17, 1989

§ 102(e) Date: May 17, 1989

[87] PCT Pub. No.: WO89/00637

PCT Pub. Date: Jan. 26, 1989

[30] Foreign Application Priority Data

| | | | |
|---|---|---|---|
| Jul. 17, 1987 | [GB] | United Kingdom | 8716960 |
| Nov. 28, 1987 | [GB] | United Kingdom | 8727909 |
| Nov. 28, 1987 | [GB] | United Kingdom | 8727910 |
| Jan. 29, 1988 | [GB] | United Kingdom | 8802042 |

[51] Int. Cl.[5] ..... E05B 9/00; E05C 21/02

[52] U.S. Cl. ..... 109/49.5; 109/51; 49/57; 49/465; 52/DIG. 12

[58] Field of Search ..... 109/49.5, 51, 79, 81, 109/64, 76, 77; 52/208, 509, DIG. 12; 411/84, 85; 49/57, 463–465

[56] References Cited

U.S. PATENT DOCUMENTS

| | | | |
|---|---|---|---|
| 2,114,499 | 4/1938 | MacLear | 49/465 |
| 2,299,158 | 10/1942 | Luce | 411/84 |

FOREIGN PATENT DOCUMENTS

| | | | |
|---|---|---|---|
| 2751219 | 5/1979 | Fed. Rep. of Germany | 52/DIG. 12 |
| 2814871 | 10/1979 | Fed. Rep. of Germany | 52/DIG. 12 |
| 2153422 | 8/1985 | United Kingdom | 49/57 |

*Primary Examiner*—Neill R. Wilson

*Attorney, Agent, or Firm*—Fleit, Jacobson, Cohn, Price, Holman & Stern

[57] ABSTRACT

A security closure comprising a panel having inner and outer sides, holding means rigidly secured to or formed on the inner side of the panel, anchor means of a length not substantially less than the height or width of the panel, and at least two spaced apart elongate connector means interconnecting the holding means on the panel and each of the anchor means, each connector means being adapted at one end to be releasably engaged with said spaced holding means and being so connectable with the anchor means as to clamp an opening surround between the panel inner side and the anchor means with the anchor means extending generally parallel to the panel.

4 Claims, 6 Drawing Sheets

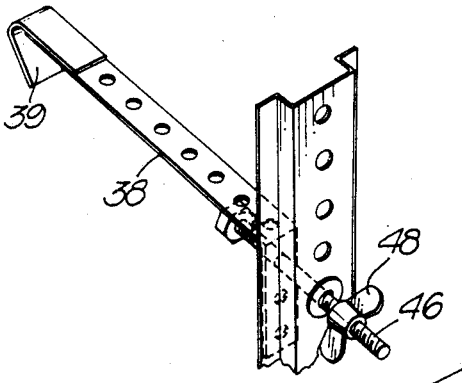
Fig.6A.
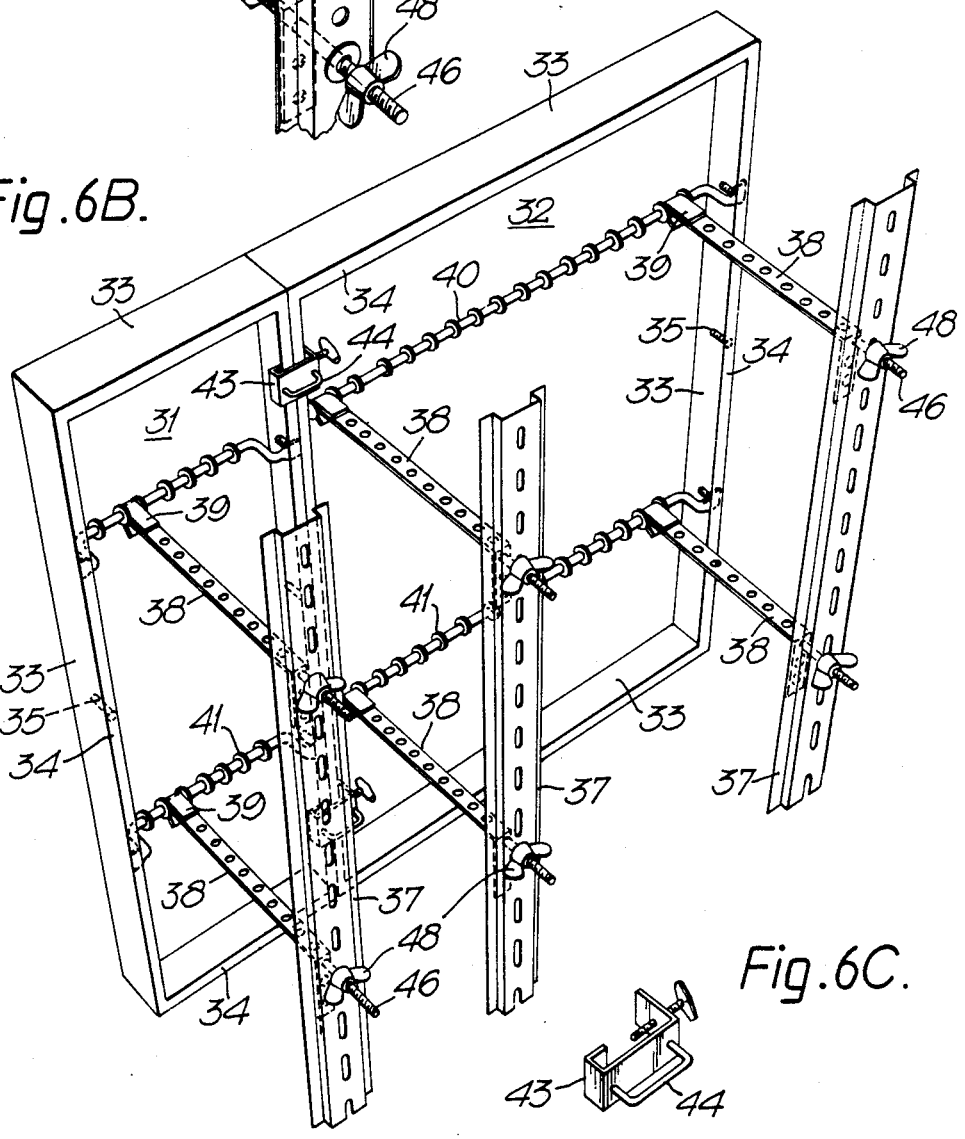
Fig.6B.
Fig.6C.

SECURITY CLOSURE

The invention relates to a security closure for use in protecting windows and like openings in temporarily unoccupied premises.

Property which is temporarily vacant for one reason or another, for example, during building renovation or between tenancies is being increasingly subject to damage due to theft and vandalism. Early attempts to protect such property involved securing wooden or reinforced panels to the outer skin of the building around the opening. The means of fixing the panels have proved to be easily accessible from the outside and so lacking in security.

A recent proposal of security closure comprises a panel having a shallow peripherally extending side wall having inwardly turned rim portions extending along opposed parallel sides of the panel and formed and arranged for captively retaining respective end portions of at least two support members so as to permit lateral sliding movement of the support members in a direction parallel to the opposed sides while restraining them against movement perpendicular to the principal plane of the panel. At least two spaced apart elongate connector means are connected to each of the support members and anchor means are provided having a length not substantially less than the length or width of the panel. The connector means and anchor means are formed and arranged for securing the connector means to the anchor means so as to clamp an opening surround between the panel side wall and the anchor means with the anchor means extending generally parallel to the panel.

Since the means of fixing the panels are not easily accessible from outside, security is enhanced. However, the provision of the captive but slidable support members with the panel is a somewhat elaborate and expensive feature.

According to the present invention there is provided a security closure comprising a panel having inner and outer sides, holding means rigidly secured to or formed on the inner side of the panel, anchor means of a length not substantially less than the height or width of the panel, and at least two spaced apart elongate connector means interconnecting the holding means on the panel and each of the anchor means, each connector means being adapted at one end to be releasably engaged with said holding means and being so connectable with the anchor means as to clamp an opening surround between the panel inner side and the anchor means with the anchor means extending generally parallel to the panel.

Such a structure is easy to assemble and yet provides all the necessary security. Because the holding means are rigidly secured to or formed on the inner side of the panel there can be no possibility of their moving either during or after installation thereby facilitating installation and improving security.

The panel can have any form but preferably has a shallow peripherally extending side wall having an inwardly turned rim. The holding means may comprise formations integral with the panel near the periphery thereof, but concealed by the side wall for example being formed on said side wall or on said inwardly turned rim.

Preferably, in order to ensure that the connector means do not move laterally and again to improve security, the holding means define a plurality of spaced holding locations and said one end of said connector means is adapted to be releasably engaged with one of said spaced holding locations. Such a structure may take many forms and one of these are a number of apertures, notches or the like formed in the rim or in the side wall either integrally therewith or by tabs secured to or formed integrally with the side walls.

An alternative approach is for the holding means to include at least one bar extending across said inner side of the panel, said bar being provided with a plurality of spaced projections or recesses to define said plurality of spaced holding locations. The or each bar may be secured to the inner side of the panel at any location but preferably it is secured to the side wall and/or to the side wall rim. With the construction of the present invention the connector means are preferably provided with a head or a hook which is engagable with the holding means and in particular engagable, where provided, at one of the spaced holding locations.

In order that the present invention may more readily be understood, the following description is given, merely by way of example, reference being made to the accompanying drawings, in which.

Figure 7C:
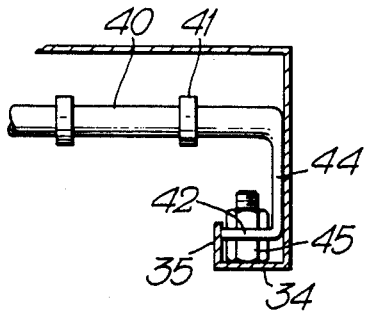
Figure 7A:
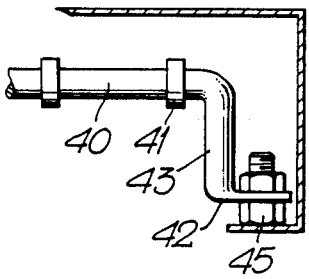
Figure 7D:
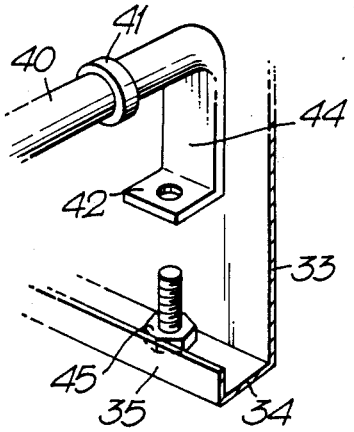
Figure 7B:
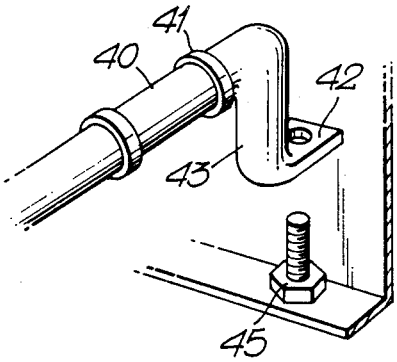
Figure 8:
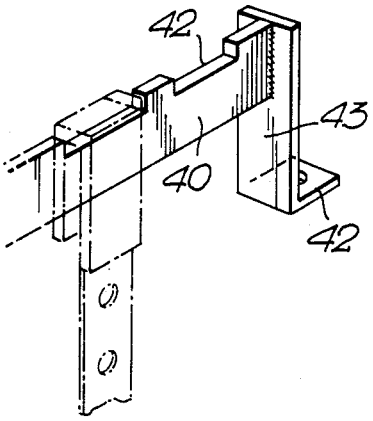
Figure 9:
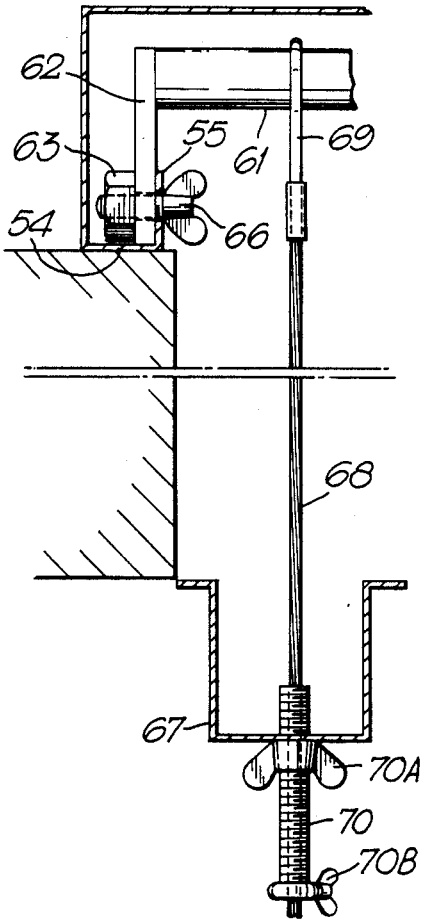

FIGS. 6A, 6B and 6C include a perspective view and two fragmentary views of a third embodiment of closure according to the invention;

FIGS. 7A to 7D illustrate two different methods of securing the rigid bar of FIG. 6 to the panel;

FIG. 8 is a view similar to FIG. 7B showing a modified form of bar;

FIG. 9 is a side elevation of a further embodiment; and

Figure 10:
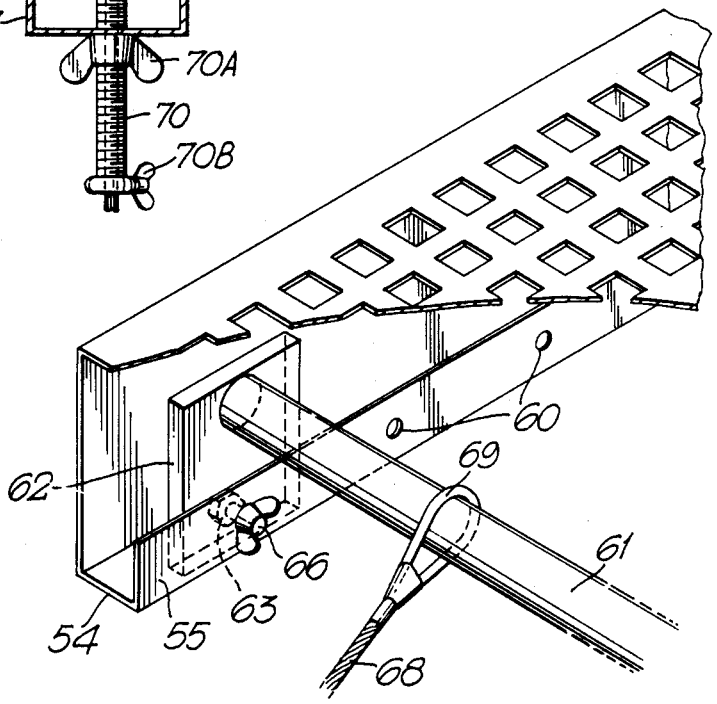

FIG. 10 is a perspective view, partly broken away, of the embodiment of FIG. 9.

Figure 1:
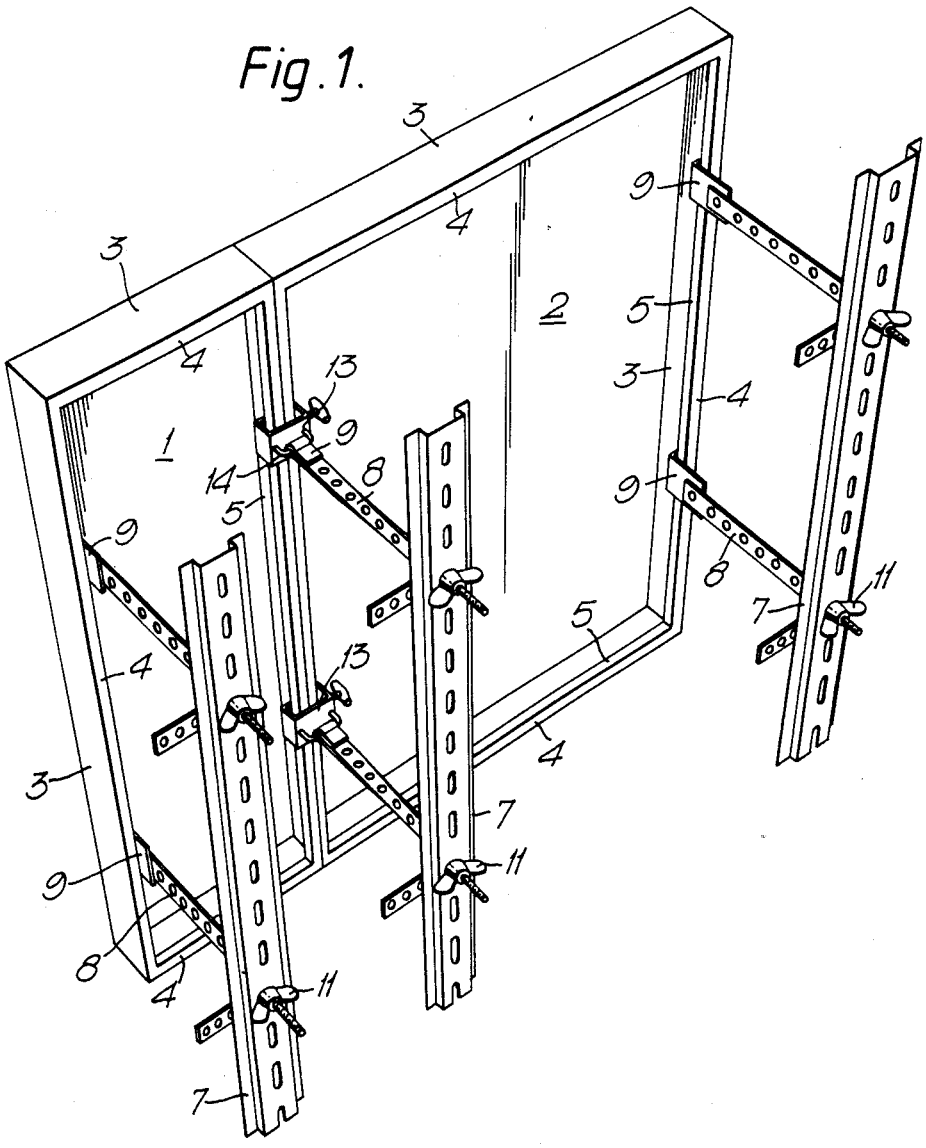
FIG. 1 is a perspective view of one embodiment of security closure according to the invention as it would appear when fitted to a window opening, but with a window opening omitted.
Figure 2:
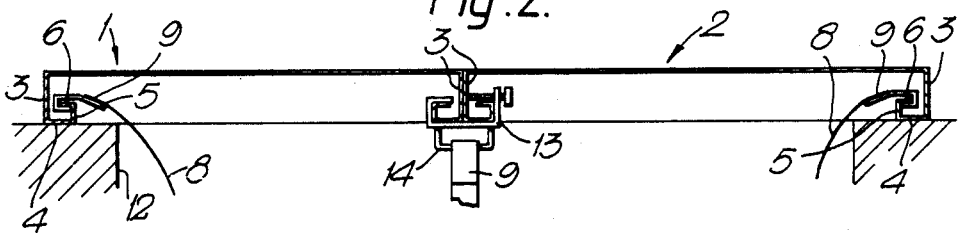
FIG. 2 is a plan view, in section, showing part of the closure of FIG. 1 fitted in a window opening.

It is envisaged to provide ranges of panels of three different heights each having two different widths. Referring to FIGS. 1 and 2, two panels 1 and 2 have the same height, but different widths in FIG. 1 and the same width in FIG. 2. This shows how various sizes of window openings which can be covered. Each panel has a peripherally extending side wall 3. The side wall 3 has an inwardly turned first rim 4. The first rim 4 is extended into a second rim 5 turned back parallel to the side wall 3 and a third rim 6 turned outwards parallel to the rim 4.

The rims 5 and 6 constitute hook engageable formations integral with the panel near the periphery thereof but concealed by the side wall 3. Anchor means are provided in the form of top hat section steel bars 7 each apertured along its length which is not substantially less than the height of either panel. A number of elongate connector means are provided each comprising a flexible steel strap 8 apertured along its length. At one end of the strap 8 a flat strip like hook 9 is attached and this is engaged over the rim 6. A bolt 10 with a T-shaped head (not shown) is inserted through convenient apertures in the strap 8 and the bar 7 and a wing nut 11 is tightened on the bolt 10 so as to clamp the surround of a window opening 12 between the panel side wall 3 and the bars 7 with the bars 7 extending generally parallel to the panel.

Where two or more panels are used to cover one opening the adjacent side walls 3 are held together by a G-clamp 13 to which a bail 14 is secured for engagement by the hook 9.

Figure 3:
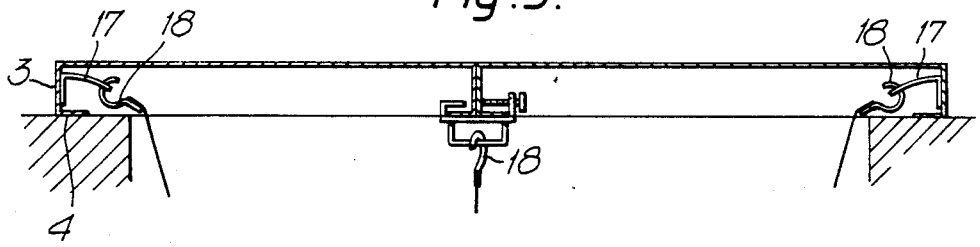
FIG. 3 is a view similar to FIG. 2 of a modification.

FIG. 3 shows a modified construction in which there is no extension of the inwardly turned rim and the bails 17 are welded to the inner surface of the side wall 3. Also shown in FIG. 3 is a variation in that the flat strip like hook is replaced by a rod like hook.

Figure 5:
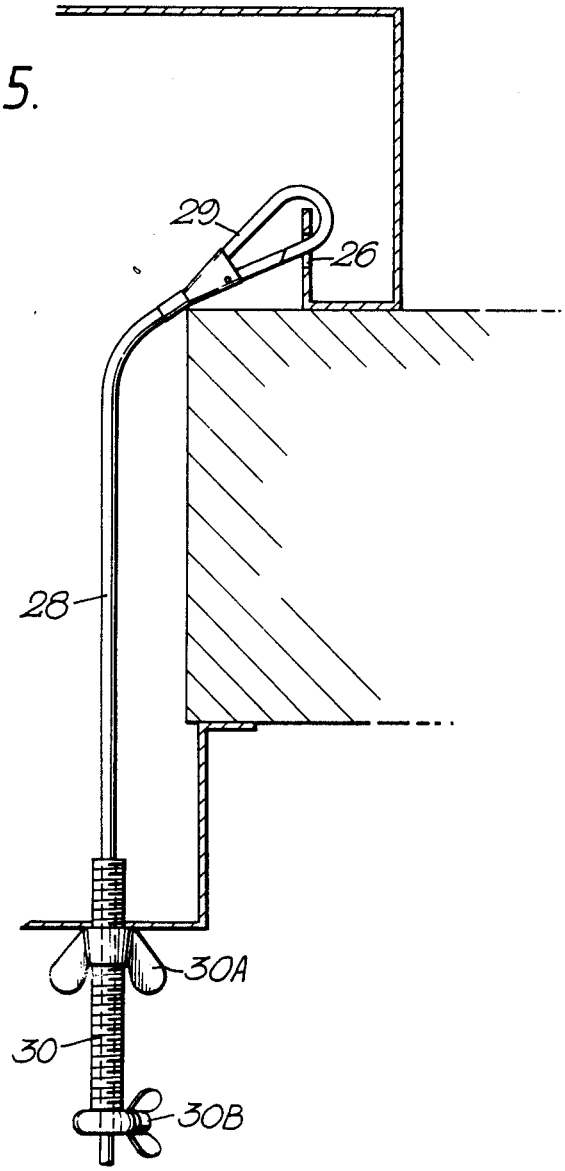
FIG. 5 is an enlarged fragmentary view showing the edge of the panel of FIG. 4.
Figure 4:
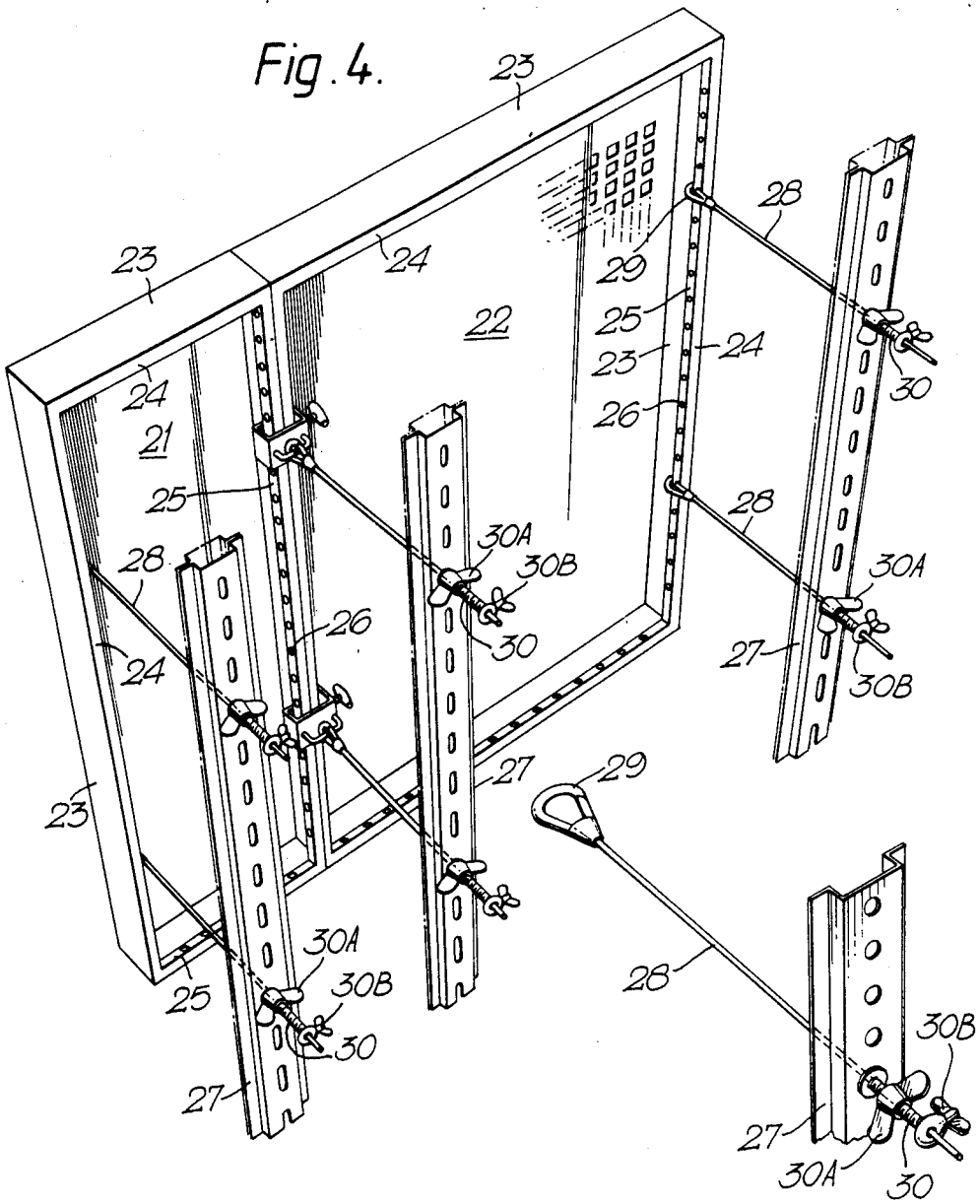
FIG. 4 is a view similar to FIG. 1 of a second construction.

In the second construction illustrated in FIGS. 4 and 5 like parts are indicated with the addition of 20. It can be seen that holes 26 are spaced along the rim 25 and constitute hook engageable formations integral with the panel near the periphery thereof, but concealed by the side wall 23. Anchor means are provided in the form of top hat section steel bars 27 each apertured along its length which is not substantially less than the height of either panel. A number of elongate connector means are provided, each in the form of a wire rope 28 having, at one end, a safety hook 29 engaging with a selected hole 26. An externally screw threaded sleeve 30 carrying a wing nut 30A is slid over the wire rope 28 and inserted into the aperture in the bar 27 until the wing nut 30A abuts the bar 27. The wire rope 28 is pulled tight by hand and a screw clamp 30B is applied to the wire rope 28 in abutment with the sleeve 30 and possibly welded to the wire rope 28. Thereafter, the wing nut 30A is tightened.

In an alternative arrangement the sleeve 30 is replaced by a bolt with an eye or a transverse hole at one end. The wire rope can be inserted at its free end through the eye or hole and jammed and kicked in place by a first wing nut. Only the bolt extends through the aperture in the bar 27 and a second wing nut on the bolt tightens the assembly.

In a further construction illustrated in FIGS. 5, 6A–6C, AND 7A–7D, like parts to those of FIGS. 1 to 3 are shown with the addition of 30. Holding means are provided in the form of top hat section steel bars 37 each apertured along its length which is not substantially less than the height of the panel. A number of elongate connector means are provided, each comprising a flexible seal strap 38 apertured along its length. At one end of the strap 38 a flat strip-like hook 39 is attached, and this is engaged in a selected one of a number of recessed spaced apart holding location portions of an elongate supporting rod 40 formed between fixed collars 41 spaced apart along the rod 40. Alternatively, the recessed portions may be machined from the rod and FIG. 8 illustrates a strip like bar 40 with the recessed portions formed as notches 42. In FIG. 7A and 7B end portions 42 extend outwards from cranked parts 43 and are held by bolts 45. In FIG. 7C and 7D the end portions 42 extend inwards from end cranked portions 44 and the rim 34 is extended by a rim 35 turned back parallel to the side wall 33.

A bolt 46 is inserted through apertures in the strap 38 and the bar 37, and a wing nut 48 is tightened on the bolt 46 so as to clamp the surround of a window opening between the panel side walls 33 and the bars 37, the bars 37 extending generally parallel to the panel.

Where two or more panels are used to cover one opening, the adjacent side panels 31 are held together by a G-clamp 48 to which a bail 49 is secured for engagement by the hook 39.

With the mounting bolts 45 fixed to the panel and the hooks 39 engaged in recessed portions of the support members, the installed panel is resistant to sliding movement caused by hammer blows in its principal plane. Furthermore, the assymetrical arrangement of the mounting bolts 45 renders the closure more adaptable to various situations without the need for a large number of mountings.

Referring now to FIGS. 9 and 10, the rim 54 is again extended by the rim 55 as in FIGS. 7C and 7D. However, instead of the bolts 45, the mountings are provided in the form of holes 60 spaced along the rim 55. A support member is in the form of a plain rod 61 with end cranked plates 62. Each plate 62 has a hole therethrough which is extended by captive nut 63 on the outside of the plate. A wing headed screw 66 is inserted through a selected hole 60 in the rim 55 and the hole in the plate 62 and screwed into the nut 63. Each elongate connector means is provided in the form of a wire rope 68 having, at one end, a safety hook 69 engaging over the rod 61.

The free end of the wire rope 68 is inserted through an aperture in a bar 67. An external screw threaded sleeve 70 carrying a wing nut 70A is slid over the wire rope 68 and inserted into the aperture in the bar 67 until the wing nut 70A abuts the bar 67. The wire rope 68 is pulled tight by hand and a screw clamp 70B is applied to the wire rope 68 in abutment with the sleeve 70 and possibly welded to the wire rope. Thereafter the wing nut 70A is tightened.

In an alternative arrangement, the sleeve 70 is replaced by a bolt with an eye or a transverse hole at one end. The wire rope can be inserted at its free end through the eye or hole and jammed and kinked in place by a first wing nut. Only the bolt extends through the aperture in the bar and the second wing nut on the bolt tightens the assembly.

I claim:

1. A security closure comprising a rectangular continuous plate like panel having a front and a rear face and a periphery, a shallow, rearwardly extending peripheral sidewall extending around the full periphery of the panel and having an outer edge formed integrally with the panel and an inner edge, an inwardly turned rim formed at the inner edge of the peripheral wall, said rim forming, with said panel and said peripheral sidewall, a peripheral channel, peripherally spaced holding elements rigidly secured to said panel within said peripheral channel, elongate anchor means of a length not substantially less than the height or width of the panel, and at least two spaced apart flexible elongate connector means interconnecting the spaced holding elements and each of the anchor means, each flexible elongate connector means being adapted, at one end thereof, to be releasably engaged with said spaced holding elements and being so connectable with said anchor means as to clamp an opening surround in the inwardly turned rim and said elongate anchor means, with said elongate anchor means then extending generally parallel to said panel.

2. A security closure comprising a rectangular continuous plate like panel having a front and a rear face and a periphery, a shallow, rearwardly extending peripheral sidewall extending around the full periphery of the panel and having an outer edge formed integrally with the panel and an inner edge, an inwardly turned rim formed at the inner edge of the peripheral wall, said rim forming, with said panel and said peripheral sidewall, a peripheral channel, a second forwardly turned rim formed on the inner edge of the first rim and extending substantially parallel to said peripheral wall, a plurality of peripherally spaced holes formed in said second rim, elongate anchor means of a length not substantially less than the height or width of the panel, and at least two spaced apart flexible elongate connector means interconnecting the holes in the second rim on the panel and each of the anchor means, each connector means being adapted at one end to be releasably engaged in said spaced holes and being so connectable with the anchor means as to clamp an opening surround between the first rim and the anchor means, with the anchor means than extending generally parallel to the panel.

3. A security closure comprising a rectangular plate like panel having front and rear faces and a periphery, a shallow, rearwardly extending peripheral side wall extending around the full periphery of the panel and having an outer edge formed integrally with the panel and an inner edge, an inwardly turned first rim formed on the inner edge of the peripheral wall, said first rim forming with the panel and the peripheral wall a peripheral channel, a forwardly turned second rim connected to the inner periphery of the first rim said second rim extending substantially parallel to the peripheral wall and a third rim formed integrally with the second rim and extending outwardly towards, but spaced from, the peripheral wall, elongate anchor means of a length not substantially less than the height or width of the panel, at least two spaced apart elongate connector means, a hook formed on one end of each of said connector means said hook being engageable with the third rim whereby each connector means is adapted to be releasably engaged with said third rim, said connector means being so connectable with the anchor means as to clamp an opening surround between the panel peripheral wall and the anchor means, with the anchor means then extending generally parallel to the panel.

4. A security closure comprising a rectangular plate like panel having front and rear faces and a periphery, a shallow, rearwardly extending peripheral side wall extending around the full periphery of the panel and having an outer edge formed integrally with the panel and an inner edge, an inwardly turned rim formed on the inner edge of the peripheral wall, said rim forming with the panel and the peripheral side wall a peripheral channel, at least one bar extending across the panel and spaced rearwardly from the rear face thereof, ends of said bar being rigidly secured to said panel at the location of said peripheral channel, said at least one bar being provided with a plurality of spaced projections or recesses defining a plurality of spaced holding locations, elongate anchors means of a length not substantially less than the height or width of said panel and at least two spaced apart flexible elongate connector means interconnecting said spaced apart holding locations on said at least one bar and each of said anchor means, each elongate flexible connector means being adapted at one end to be releasably engaged with said spaced holding locations and being so connectable with said anchor means as to clamp an opening surround between said rim of the panel and the anchor means, with the anchor means then extending parallel to the panel.

* * * * *